US009236208B2

(12) United States Patent
Ukon et al.

(10) Patent No.: US 9,236,208 B2
(45) Date of Patent: Jan. 12, 2016

(54) CUTTER FOR A CURRENT-CARRYING MEMBER

(75) Inventors: Tetsuya Ukon, Osaka (JP); Teruaki Tsuchiya, Osaka (JP); Futoshi Okugawa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 333 days.

(21) Appl. No.: 13/994,419

(22) PCT Filed: Nov. 28, 2011

(86) PCT No.: PCT/JP2011/006603

§ 371 (c)(1),
(2), (4) Date: Jun. 14, 2013

(87) PCT Pub. No.: WO2012/090384

PCT Pub. Date: Jul. 5, 2012

(65) Prior Publication Data

US 2013/0255464 A1 Oct. 3, 2013

(30) Foreign Application Priority Data

Dec. 27, 2010 (JP) ..... 2010-289196

(51) Int. Cl.
*H01H 39/00* (2006.01)
*H01H 50/54* (2006.01)
(Continued)

(52) U.S. Cl.
CPC ..... *H01H 39/006* (2013.01); *H01H 50/546* (2013.01); *H01H 71/02* (2013.01); *H01H 89/00* (2013.01); *Y10T 83/8858* (2015.04)

(58) Field of Classification Search
CPC ..... H01H 39/006; H01H 89/00; H01H 71/02; H01H 50/546; Y10T 83/8858
USPC ..... 337/30, 157, 401, 405; 361/115; 200/61.08
See application file for complete search history.

(56) References Cited

U.S. PATENT DOCUMENTS 3,277,255 A * 10/1966 Mattsson et al. ..... 200/61.08
3,660,794 A * 5/1972 Brizzolara ..... 337/401
3,873,786 A * 3/1975 Lagofun ..... 200/61.08
(Continued)

FOREIGN PATENT DOCUMENTS

JP 2000-123695 A 4/2000
JP 2010-86653 A 4/2010

*Primary Examiner* — Anatoly Vortman
(74) *Attorney, Agent, or Firm* — Birch, Stewart, Kolasch & Birch, LLP

(57) ABSTRACT

A cutter including a blade member (30) having an edge portion (31) for cutting a current-carrying member (12) and an insulating portion (32); a gas generator (35) that generates high-pressure gas to move the blade member (30) toward the current-carrying member (12); a receiving member (25) arranged on a side opposite to the edge portion (31) relative to the current-carrying member (12) and defining a receiving surface (25*b*) for receiving the current-carrying member (12) upon cutting thereof; a stopper (23) configured to restrict forward movement of the blade member (30) such that the insulating portion (32) of the blade member (30) stops, after cutting of the current-carrying member (12), at a position corresponding to a cut surface of the current-carrying member (12); and an insulating protective member (15) positioned between at least one of the blade member (30) or the receiving member (25) and the current-carrying member (12) and configured to protect a surface of the current-carrying member (12) facing the at least one of the blade member (30) or the first inner cylinder member (25) are provided.

11 Claims, 9 Drawing Sheets

(51) Int. Cl.
*H01H 71/02* (2006.01)
*H01H 89/00* (2006.01)

(56) References Cited

U.S. PATENT DOCUMENTS 3,915,236 A * 10/1975 Stichling ..... 169/61
3,932,717 A * 1/1976 Dike et al. ..... 200/61.08
4,224,487 A * 9/1980 Simonsen ..... 200/61.08
4,311,890 A * 1/1982 Schroder ..... 200/61.08
4,417,519 A * 11/1983 Lutz ..... 102/263
5,070,787 A * 12/1991 Weldon et al. ..... 102/216
5,535,842 A * 7/1996 Richter et al. ..... 180/279
5,877,563 A * 3/1999 Krappel et al. ..... 307/10.1
6,194,988 B1 * 2/2001 Yamaguchi et al. ..... 337/157
6,222,439 B1 * 4/2001 Tanigawa et al. ..... 337/401
6,232,568 B1 * 5/2001 Hasegawa et al. ..... 200/61.08
6,295,930 B1 * 10/2001 Kume et al. ..... 102/202.5
6,483,420 B1 * 11/2002 Takahashi et al. ..... 337/401
6,556,119 B1 * 4/2003 Lell ..... 337/157
6,843,157 B2 * 1/2005 Hamilton et al. ..... 83/639.4
7,123,124 B2 * 10/2006 Caruso et al. ..... 337/157
7,205,879 B2 * 4/2007 Kordel et al. ..... 337/401
7,222,561 B2 * 5/2007 Brede et al. ..... 83/639.4
7,239,225 B2 * 7/2007 Tirmizi ..... 337/30
7,772,958 B2 * 8/2010 Schlotzer ..... 337/157
8,432,246 B2 * 4/2013 Suzuki et al. ..... 337/157
2004/0041682 A1 * 3/2004 Pasha et al. ..... 337/401
2010/0218659 A1 * 9/2010 Ukon et al. ..... 83/639.1

* cited by examiner

CUTTER FOR A CURRENT-CARRYING MEMBER

TECHNICAL FIELD

The present disclosure relates to a cutter configured to cut a current-carrying member.

BACKGROUND ART

Cutters configured to cut current-carrying members through which current flows have been known. Such cutters are used to shut off power from a power supply in, e.g., disaster situations. Patent Document 1 discloses, as the cutters of this type, a cutter including a blade (blade member) configured to cut a current-carrying member by thrust generated by explosion of an explosive filling a cylinder, a cylindrical member (receiving member) configured to receive the current-carrying member upon cutting of the current-carrying member by the blade, and a stopper configured to stop the blade at a predetermined position after cutting of the current-carrying member. The blade includes an edge portion in which a cutting portion configured to cut the current-carrying member is formed, and an insulating portion having insulating properties.

When the explosive inside the cylinder explodes in the cutter, the blade moves toward the current-carrying member, and the cutting portion cuts the current-carrying member. Subsequently, the blade further moves to the position where the insulating portion of the blade contacts cut surfaces of the current-carrying member, and then is stopped by the stopper. Thus, since the insulating portion of the blade is interposed between cut portions of the current-carrying member, it can be ensured that passage of current in the current-carrying member is disconnected.

CITATION LIST

Patent Document

PATENT DOCUMENT 1: Japanese Patent Publication No. 2010-086653

SUMMARY OF THE INVENTION

Technical Problem

If the cutter or the current-carrying member shakes before cutting of the current-carrying member, the current-carrying member may be rubbed against the cutting portion or the receiving member of the cutter. In such a case, a surface of the current-carrying member is shaved, thereby generating metal powder. As a result, even after the current-carrying member is cut by the cutter, there is a possibility that current re-flows between the cut portions of the current-carrying member through the metal powder.

The present disclosure has been made in view of the foregoing, and it is an objective of the present disclosure to reduce generation of metal powder due to rubbing of a surface of a current-carrying member.

Solution to the Problem

A first aspect of the invention is intended for a cutter including a blade member (30) including an edge portion (31) and an insulating portion (32) and configured to cut a current-carrying member (12) by the edge portion (31); a gas generator (35) configured to generate high-pressure gas to move the blade member (30) toward the current-carrying member (12); a receiving member (25) arranged on a side opposite to the edge portion (31) relative to the current-carrying member (12) and defining a receiving surface (25*b*) for receiving the current-carrying member (12) upon cutting thereof; a stopper (23) configured to restrict forward movement of the blade member (30) such that the insulating portion (32) of the blade member (30) stops, after cutting of the current-carrying member (12), at a position corresponding to a cut surface of the current-carrying member (12); and an insulating protective member (15) positioned between at least one of the blade member (30) or the receiving member (25) and the current-carrying member (12) and configured to protect a surface of the current-carrying member (12) facing the at least one of the blade member (30) or the first inner cylinder member (25).

In the first aspect of the invention, when high-pressure gas is generated by the gas generator (35), the blade member (30) moves toward the current-carrying member (12), and the cutting portion (31*a*) of the edge portion (31) of the blade member (30) reaches the current-carrying member (12). The blade member (30) further moves, and then the cutting portion (31*a*) of the edge portion (31) cuts the current-carrying member (12) received by the receiving surface (25*b*) of the receiving member (25). Subsequently, after the blade member (30) moves to the position at which the insulating portion (32) of the blade member (30) contacts the cutting surface of the current-carrying member (12), the blade member (30) is stopped in such a manner that the stopper (23) restrict movement of the blade member (30). In such a state, the insulating portion (32) is interposed between cut portions of the current-carrying member (12), and therefore passage of current in the current-carrying member (12) is disconnected.

Moreover, in the first aspect of the invention, the insulating protective member (15) is provided between at least one of the blade member (30) or the receiving member (25) and the current-carrying member (12). Thus, even if the cutter shakes before cutting of the current-carrying member (12), rubbing of the current-carrying member (12) against at least one of the blade member (30) or the receiving member (25) is reduced or prevented. As a result, generation of metal powder due to shaving of a surface of the current-carrying member (12) is reduced. Further, even if powder is generated from the protective member (15), such powder has insulating properties, and therefore current does not re-flow in the current-carrying member (12) through the powder.

A second aspect of the invention is intended for the cutter of the first aspect of the invention, in which the protective member (15) is provided on the current-carrying member (12) so as to cover surfaces of the current-carrying member (12) facing the blade member (30) and the first inner cylinder member (25).

In the second aspect of the invention, since the protective member (15) is provided on the current-carrying member (12), it is ensured that shaving of the current-carrying member (12) is reduced.

A third aspect of the invention is intended for the cutter of the first aspect of the invention, in which the protective member (15) is provided on the edge portion (31), guide portions (32*a*) formed in a front end portion of the blade member (30) so as to sandwich the current-carrying member (12), and the receiving member (25) so as to cover a surface of the edge portion (31), inner surfaces of the guide portions (32*a*), and the receiving surface (25*b*) of the first inner cylinder member (25).

In the third aspect of the invention, the protective member (15) is provided on the edge portion (31), the guide portions (32*a*), and the first inner cylinder member (25). Thus, the protective member (15) contacts the current-carrying member (12), and therefore it is ensured that shaving of the current-carrying member (12) is reduced.

A fourth aspect of the invention is intended for the cutter of the second or third aspect of the invention, in which the protective member (15) is made of a material softer than the current-carrying member (12).

In the fourth aspect of the invention, the protective member (15) is softer than the current-carrying member (12). Thus, only the protective member (15) is shaved, and therefore it is ensured that shaving of the current-carrying member (12) is reduced.

A fifth aspect of the invention is intended for the cutter of the second aspect of the invention, in which the protective member (15) is formed in close contact with the surfaces of the current-carrying member (12).

In the fifth aspect of the invention, the protective member (15) is in close contact with the current-carrying member (12). Thus, no rubbing of the protective member (15) and the current-carrying member (12) against each other occurs, and therefore it is ensured that the current-carrying member (12) is protected.

A sixth aspect of the invention is intended for the cutter of any one of the first to fifth aspects of the invention, in which the protective member (15) is a protective film (15) formed in a membrane.

In the sixth aspect of the invention, since the protective member is the protective film (15), the distance between the current-carrying member (12) and each of the blade member (30) and the receiving member (25) which are arranged with the protective film (15) being interposed therebetween can be shortened. As a result, the blade member (30) and the receiving member (25) sandwiching the current-carrying member (12) are arranged close to each other.

Advantages of the Invention

According to the first aspect of the invention, since the insulating protective member (15) is provided between the current-carrying member (12) and each of the blade member (30) and the receiving member (25), it can be ensured that rubbing of the current-carrying member (12) against the blade member (30) and the receiving member (25) is reduced or prevented. As a result, generation of metal powder due to shaving of the surface of the current-carrying member (12) by the protective member (15) is reduced or prevented. Thus reduces passage of current between the cur portions of the current-carrying member (12) through metal powder. Moreover, the protective member (15) is made of the insulating material. Thus, even if powder is generated due to shaving of the protective member (15) by, e.g., the blade member (30), current does not flow in the current-carrying member (12) through such powder.

According to the second aspect of the invention, since the protective member (15) is provided on the current-carrying member (12), it can be ensured that shaving of the current-carrying member (12) is reduced.

According to the third aspect of the invention, the protective member (15) is provided on the edge portion (31), the guide portions (32*a*), and the receiving member (25). Thus, the protective member (15) contacts the current-carrying member (12), and therefore it can be ensured that shaving of the current-carrying member (12) is reduced.

According to the fourth aspect of the invention, the protective member (15) is softer than the current-carrying member (12). Thus, only the protective member (15) is shaved, and therefore it can be ensured that shaving of the current-carrying member (12) is reduced.

According to the fifth aspect of the invention, the protective member (15) is in close contact with the current-carrying member (12). Thus, no rubbing of the protective member (15) and the current-carrying member (12) against each other occurs, and therefore it can be ensured that the current-carrying member (12) is protected.

According to the sixth aspect of the invention, since the blade member (30) and the receiving member (25) can be arranged close to each other, the size of the entirety of the device can be reduced.

DESCRIPTION OF EMBODIMENTS

Figure 1:
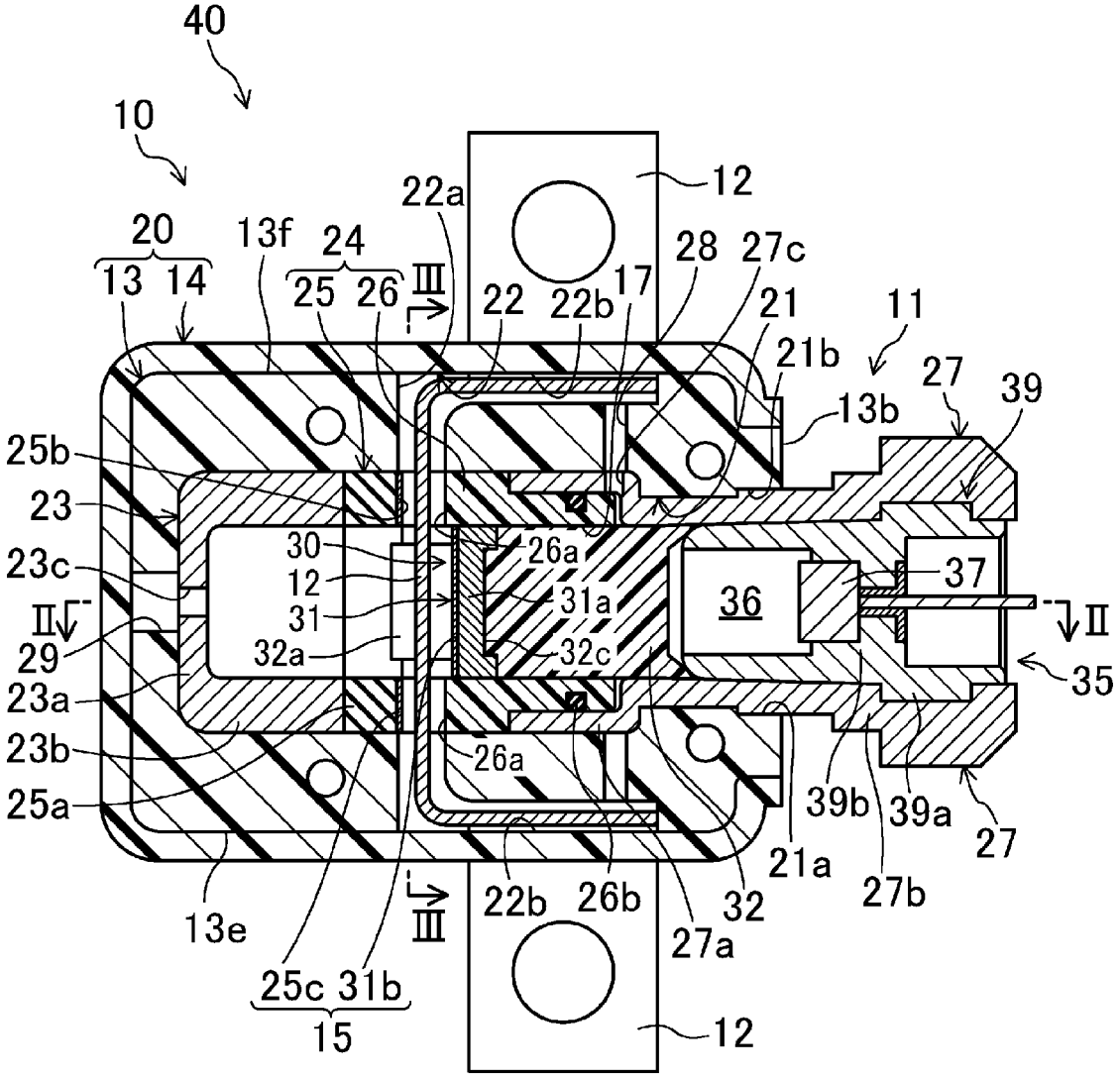
FIG. 1 is a horizontal cross-sectional view illustrating a current passage disconnection device of a first embodiment.

Embodiments of the present disclosure will be described in detail below with reference to drawings. Note that the following embodiments will be set forth merely for the purpose of preferred examples in nature, and are not intended to limit the scope, application, and use of the invention.

First Embodiment of the Invention

A current passage disconnection device (40) of a first embodiment includes a harness (12) forming a current-carrying member, and a cutter (10) configured to cut the harness (12).

The cutter (10) includes, referring to FIGS. 1-5, a case (11) and a stopper (23), an inner cylinder (24), a blade member (30), and a gas generator (35) which are accommodated in the case (11).

Figure 2:
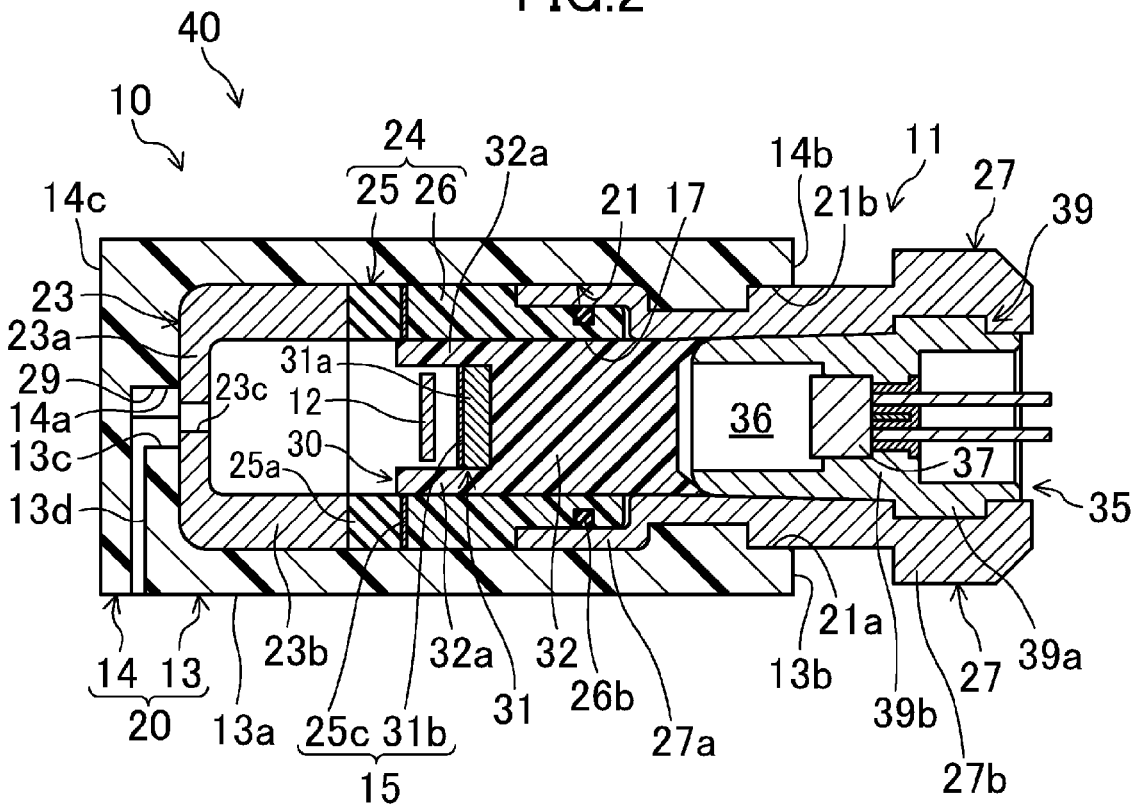
FIG. 2 is a cross-sectional view along an II-II line illustrated in FIG. 1.
Figure 3:
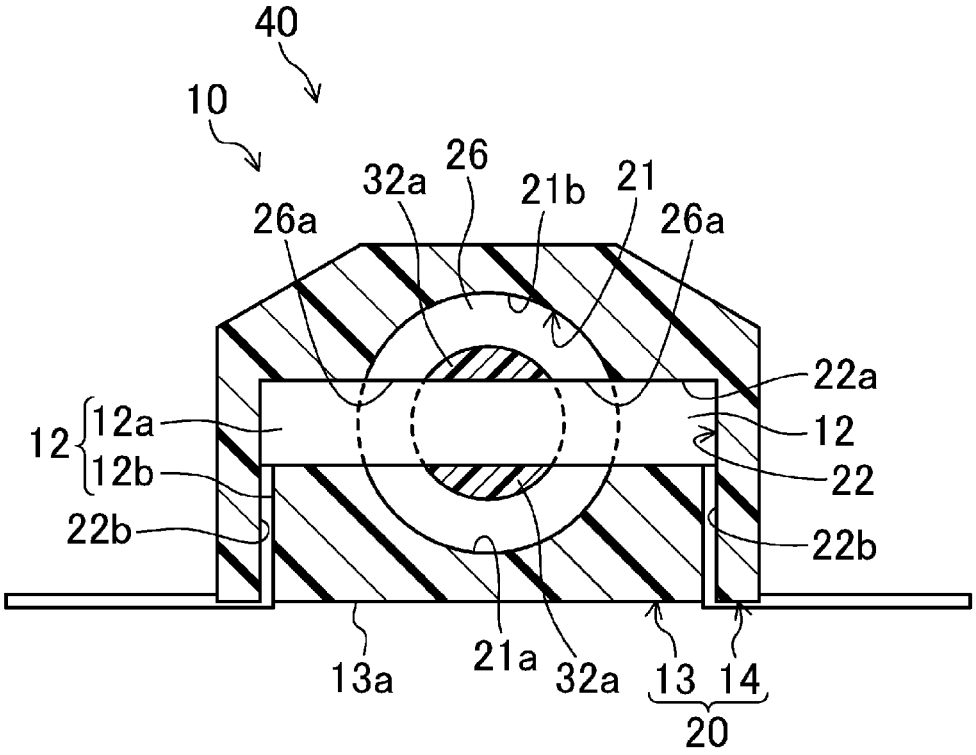
FIG. 3 is a cross-sectional view along an III-III line illustrated in FIG. 1.

For the sake of simplicity of description, the left side as viewed in FIG. 2 is hereinafter referred to as "front," the right side as viewed in FIG. 2 is hereinafter referred to as "back," the upper side as viewed in FIG. 2 is hereinafter referred to as "upper," and the lower side as viewed in FIG. 2 is hereinafter referred to as "lower." Moreover, the front side in the direction perpendicular to the plane of paper as viewed in FIG. 2 is hereinafter referred to as "left," and the back side in such a direction is hereinafter referred to as "right."

Figure 4:
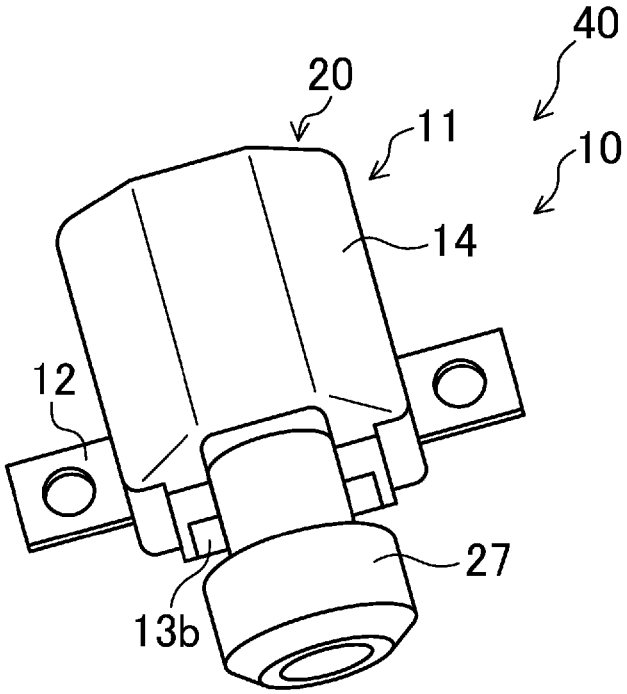
FIG. 4 is a perspective view illustrating an appearance of the current passage disconnection device of the first embodiment.
Figure 5:
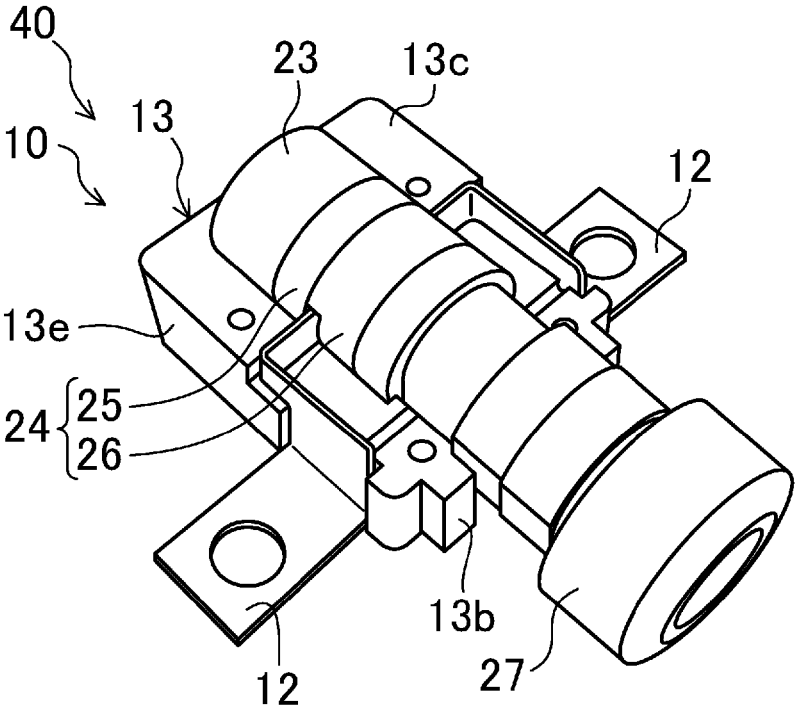
FIG. 5 is a perspective view illustrating an internal structure of the current passage disconnection device of the first embodiment without showing a cover.

Referring to FIGS. 1, 2, and 4, the case (11) includes a box-shaped resin case (20) and a cylindrical metal case (27). A front portion (27*a*) of the metal case (27) is accommodated in an insertion hole (21) (details will be described later) of the resin case (20).

The resin case (20) is made of resin such as polycarbonate (PC). The resin case (20) includes a substantially rectangular parallelepiped base (13) and a cover (14) continuously covering surfaces of the base (13) other than a lower surface (13*a*) and a back surface (13*b*) thereof. Note that the resin material forming the resin case (20) is not limited to PC, and may be a resin material containing, e.g., plastic.

The base (13) is formed in a substantially rectangular parallelepiped shape which is slightly narrow in the vertical direction. A groove (21*a*) having a semicircular cross section as viewed from the front is formed at an upper surface (13*c*) of the base (13). The groove (21*a*) extends from the back surface (13*b*) toward a front surface (13*d*) of the base (13), and opens only at the back surface (13*b*).

The cover (14) covers the upper surface (13*c*), the front surface (13*d*), a left surface (13*e*), and a right surface (13*f*) of the base (13). A groove (21*b*) having a semicircular cross section, as viewed from the front, is formed at an opposing surface (14*a*) of the cover (14) which faces the upper surface (13*c*) of the base (13). The groove (21*b*) of the cover (14) extends from the back surface (14*b*) toward the front surface (14*c*) of the cover (14), and opens only at the back surface (14*b*).

In the resin case (20), the substantially cylindrical insertion hole (21) which opens at a back end surface of the resin case (20) is formed by the groove (21*a*) of the base (13) and the groove (21*b*) of the cover (14). The stopper (23), the inner cylinder (24), and the front portion of the metal case (27) are, in this order from the front to the back, accommodated in the insertion hole (21).

In the resin case (20), a mounting hole (22), in which the harness (12) is mounted, is formed between the base (13) and the cover (14). The mounting hole (22) is symmetric with respect to a vertical plane including the center of the insertion hole (21). Specifically, the mounting hole (22) laterally extends in a center portion of the resin case (20) in the front-back direction, and then is bent so as to extend backward. Subsequently, the mounting hole (22) is bent downward so as to extend to the lower surface (13*a*) of the base (13). The mounting hole (22) includes a narrow portion (22*a*) formed by a part laterally extending from the insertion hole (21) and having a relatively-small width in the vertical direction, and a wide portion (22*b*) formed by a part downwardly extending from the narrow portion (22*a*) and having a larger width in the front-back direction than that of the narrow portion (22*a*).

The harness (12) is formed of, e.g., an elongated plate-shaped metal. The harness (12) includes, referring to FIGS. 3 and 7, a narrow portion (12*a*) extending in the right-left direction and two wide portions (12*b*) each continuously formed with a corresponding one of the ends of the narrow portion (12*a*). Each of the wide portions (12*b*) is a plate-shaped piece which is in a substantially L-shape as viewed from the front. Part of the harness (12) is mounted in the mounting hole (22) of the resin case (20) such that the narrow portion (12*a*) is located in the narrow portion (22*a*) of the mounting hole (22) and that part of the wide portion (12*b*) extending in the vertical direction is located in the wide portion (22*b*) of the mounting hole (22). The narrow portion (12*a*) forms part of the harness (12) at which the harness (12) is cut.

In the resin case (20), an exhaust passage (28), which allows communication between part of the insertion hole (21) close to the back and the wide portion (22*b*) of the mounting hole (22), is formed between the base (13) and the cover (14). The exhaust passage (28) forms part of an exhaust gas passage through which high-pressure gas generated by a later-described gas generator (35) to move the blade member (30) forward is exhausted.

In the resin case (20), an exhaust hole (29) configured to exhaust air from a front end of the insertion hole (21) is formed. The exhaust hole (29) extends toward the front from a center portion of the front end of the insertion hole (21), and then is bent downward so as to extend to the lower surface (13*a*) of the base (13).

The stopper (23) is configured to receive and stop the blade member (30) when it is moved forward. The stopper (23) is arranged in a front end portion of the insertion hole (21), and is made of a resin material in a cylindrical shape with a closed bottom. Specifically, the stopper (23) includes a discoid bottom portion (23*a*) and a cylindrical cylinder portion (23*b*), and is arranged such that the bottom portion (23*a*) is positioned close to the front relative to the cylinder portion (23*b*) in the front end portion of the insertion hole (21). A hole (23*c*) is formed in a center portion of the bottom portion (23*a*) to communicate with the exhaust hole (29) of the resin case (20). Further, the cylinder portion (23*b*) is formed so as to have an inner diameter that allows the blade member (30) to be movable.

The inner cylinder (24) is arranged in the back of the stopper (23) in the insertion hole (21). The inner cylinder (24) is configured to support the harness (12). The inner cylinder (24) includes a first inner cylinder member (25) and a second inner cylinder member (26), and the harness (12) is sandwiched between the members (25, 26).

Figure 6:
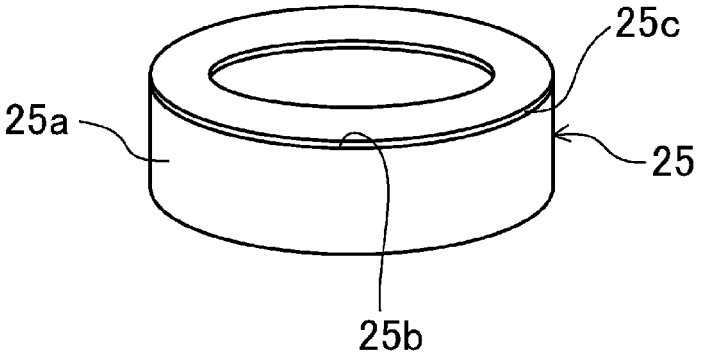
FIG. 6 is a perspective view illustrating a first inner cylinder member of the first embodiment.

The first inner cylinder member (25) is a receiving member configured to receive the harness (12) when the blade member (30) cuts the harness (12). Referring to FIG. 6, the first inner cylinder member (25) includes an inner cylinder portion (25*a*) formed in a substantially cylindrical shape, and one surface of the inner cylinder portion (25*a*) is a receiving surface (25*b*) for the harness (12). Moreover, the inner cylinder portion (25*a*) is made of a relatively-high stiffness insulating material such as ceramics. The inner cylinder portion (25*a*) is arranged in the back of the stopper (23) in the insertion hole (21) so as to be coaxial with the stopper (23). The inner cylinder portion (25*a*) has an inner diameter substantially equal to that of the cylinder portion (23*b*) of the stopper (23), and has an outer diameter substantially equal to the inner diameter of the insertion hole (21).

The second inner cylinder member (26) is made of a resin material in a substantially cylindrical shape, and is arranged in the back of the first inner cylinder member (25) in the insertion hole (21) so as to be coaxial with the first inner cylinder member (25). The second inner cylinder member (26) is formed so as to have an inner diameter substantially equal to that of the first inner cylinder member (25). Further, the second inner cylinder member (26) is formed such that a front portion thereof has an outer diameter substantially equal to the inner diameter of the insertion hole (21) and that a back portion thereof has an outer diameter smaller than that of the front portion of the second inner cylinder member (26). Two cutouts (26*a*) into which the harness (12) is inserted are formed in the front portion of the second inner cylinder member (26). The cutouts (26*a*) are formed corresponding to the mounting hole (22) of the resin case (20). Each of the cutouts (26*a*) extends from an outer circumferential surface toward an inner circumferential surface of the second inner cylinder member (26). An annular groove is formed at the outer circumferential surface of the back portion of the second inner cylinder member (26), and an O ring (26*b*) is placed in such a groove.

As described above, the inner cylinder (24) is configured to support the harness (12) by sandwiching the harness (12) between the first inner cylinder member (25) and the second inner cylinder member (26) which are insulating members.

The metal case (27) is made of a metal material in a substantially cylindrical shape. The metal case (27) includes the front portion (27*a*) formed in a substantially cylindrical shape, and a back portion (27*b*) formed in a substantially cylindrical shape and extending backward from a back portion of the front portion (27*a*).

The front portion (27*a*) is formed so as to have an outer diameter substantially equal to the inner diameter of the insertion hole (21) and to have an inner diameter substantially equal to the outer diameter of the second inner cylinder member (26). In the state in which the front portion (27*a*) is fitted onto the back portion of the second inner cylinder member (26), the front portion (27*a*) is fitted into the insertion hole (21) of the resin case (20). The front portion (27*a*) is arranged so as to be coaxial with the second inner cylinder member (26) in the back portion of the second inner cylinder member (26). Part between the front portion (27*a*) and the back portion of the second inner cylinder member (26) is sealed by the O ring (26*b*). Moreover, a through-hole (27*c*) is formed in the front portion (27*a*). The through-hole (27*c*) is formed corresponding to the exhaust passage (28) of the resin case (20). The through-hole (27*c*) forms part of the exhaust gas passage.

The back portion (27*b*) is formed so as to be coaxial with the front portion (27*a*) and to extend backward from the back portion of the front portion (27*a*). The back portion (27*b*) is formed so as to have an inner diameter substantially equal to that of the second inner cylinder member (26). In a state in which the front portion (27*a*) is fitted into the insertion hole (21) of the resin case (20), the back portion (27*b*) is exposed through the resin case (20).

The stopper (23), the inner cylinder (24), and the metal case (27) which are accommodated in the insertion hole (21) as described above form a substantially cylindrical passage (17) in the insertion hole (21). The cylindrical passage (17) has a front end portion closed by the bottom portion (23*a*) of the stopper (23) and a back end portion closed by the gas generator (35) accommodated in the metal case (27). Part of the narrow portion (12*a*) of the harness (12) accommodated in the mounting hole (22) is exposed in the cylindrical passage (17), and the blade member (30) is accommodated between such an exposed part and the gas generator (35).

The gas generator (35) is configured to generate high-pressure gas for moving the blade member (30) forward to cut the harness (12). The gas generator (35) includes an explosive as a gas generating agent, an igniter (37) configured to initiate the explosive, and a lid member (39) configured to hold the igniter (37) and close the back end portion of the cylindrical passage (17).

The lid member (39) includes a cylinder portion (39*a*) formed in a substantially cylindrical shape and fitted into the metal case (27), and a closing portion (39*b*) which holds the igniter (37) and closes a middle portion of the cylinder portion (39*a*). The cylinder portion (39*a*) and the closing portion (39*b*) are integrally formed using a metal material. A closed space is, by the closing portion (39*b*), formed in the back of the blade member (30) in the cylindrical passage (17). The closed space forms a gas generation chamber (36) filled with the explosive.

The igniter (37) is a detonator, and is held by the closing portion (39*b*) of the lid member (39) such that a front end portion of the igniter (37) where a primary explosive is provided is exposed in the gas generation chamber (36).

Figure 7:
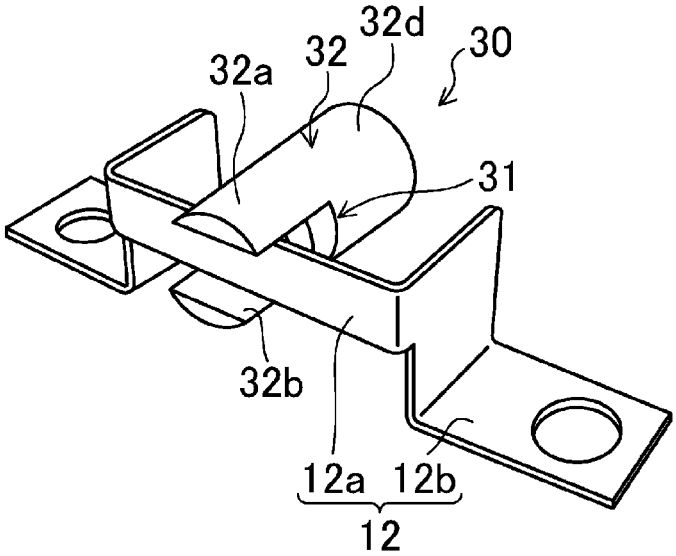
FIG. 7 is a perspective view illustrating a blade member and a harness of the first embodiment.
Figure 8:
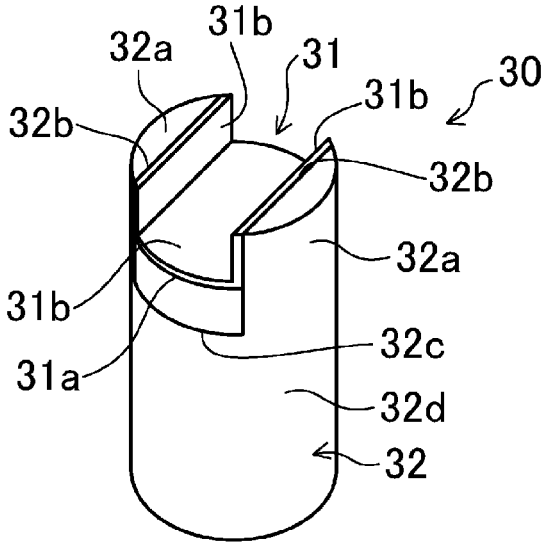
FIG. 8 is a perspective view illustrating the blade member of the first embodiment.

The blade member (30) is configured to move forward in the cylindrical passage (17) to cut the harness (12). Referring to FIGS. 7 and 8, the blade member (30) includes a metal edge portion (31) (e.g., a copper edge portion), and a pusher (32) to which the edge portion (31) is attached. A cutting portion (31*a*) configured to cut the harness (12) is formed at a tip end surface of the edge portion (31). Note that the edge portion (31) may be, other than metal, made of ceramics, resin, etc.

The pusher (32) is an insulating portion having insulating properties, and is made of a resin material. The pusher (32) is configured to hold the edge portion (31) and to receive the pressure of high-pressure gas from the igniter (37) to move toward the harness (12). The pusher (32) includes a body (32*d*) and a front end portion (32*c*).

The front end portion (32*c*) forms a pair of guide portions (32*a*) each protruding forward from a corresponding one of side portions of the body (32*d*) at a front end thereof. A tip end portion, i.e., the front end portion (32*c*), of the pusher (32) is formed in a substantially U-shape as viewed from the side. In the front end portion (32*c*), the edge portion (31) is attached on a base end side.

The guide portions (32*a*) are made of the same resin material as that of the pusher (32) so as to be integrally formed with the pusher (32). Each of the guide portions (32*a*) is a protruding piece formed so as to define an arc outer surface and a flat inner surface in a cross section along a plane perpendicular to the axis of the blade member (30). The guide portions (32*a*) are arranged such that inner surfaces (32*b*) thereof face each other. Each of the guide portions (32*a*) contacts, at a tip end of the inner surface (32*b*) thereof, a side portion of the narrow portion (12*a*) of the harness (12).

At a base end of the front end portion (32*c*) of the pusher (32), the edge portion (31) is attached so as to be interposed between the guide portions (32*a*). A surface, i.e., a tip end surface, of the edge portion (31) forms the flat cutting portion (31*a*).

Protective Member of Harness

The current passage disconnection device (40) further includes a protective member (15) of the harness (12). The protective member (15) is positioned between the blade member (30) and the harness (12) and between the first inner cylinder member (25) and the harness (12), and is configured to protect a surface of the harness (12) facing the blade member (30) and another surface of the harness (12) facing the first inner cylinder member (25). That is, the protective member (15) reduces or prevents shaving of the surface of the pre-cut harness (12) due to rubbing between the harness (12) and the blade member (30) or between the harness (12) and the first inner cylinder member (25).

The protective member (15) is an insulating member covering a surface of the cutting portion (31*a*) of the edge portion (31), the inner surfaces (32*b*) of the guide portions (32*a*), and the receiving surface (25*b*) of the first inner cylinder member (25). The protective member (15) includes an inner-cylinder-side protective film (25*c*) and a cutter-side protective film (31*b*).

The inner-cylinder-side protective film (25*c*) is formed so as to cover the receiving surface (25*b*) of the inner cylinder portion (25*a*) of the first inner cylinder member (25). The inner-cylinder-side protective film (25*c*) is formed in the substantially same annular shape as that of the inner cylinder portion (25*a*) as viewed in an axial direction, and has a relatively-small thickness. The inner-cylinder-side protective film (25*c*) is made of an insulating resin material (specifically, polytetrafluoroethylene (PTFE) etc.) softer than the material, such as metal, forming the harness (12). That is, the inner-cylinder-side protective film (25*c*) is formed of a resin film for one side of which adhesion processing is performed.

The cutter-side protective film (31*b*) is an insulating member covering the surface of the cutting portion (31*a*) of the edge portion (31) and the inner surfaces (32*b*) of the guide portions (32*a*). The cutter-side protective film (31*b*) is formed in an U-shape so as to extend from the cutting portion (31*a*) to the inner surfaces (32*b*) of the guide portions (32*a*), and has a relatively-small thickness. The cutter-side protective film (31*b*) is made of an insulating resin material (specifically, polytetrafluoroethylene (PTFE) etc.) softer than the material forming the harness (12). That is, the inner-cylinder-side protective film (25*c*) is formed of a resin film for one side of which adhesion processing is performed.

Note that the materials forming the inner-cylinder-side protective film (25*c*) and the cutter-side protective film (31*b*) are not limited to the resin materials as described above, and any material may be used as long as such materials are softer than the material forming the harness (12) and have insulating properties. For example, paper may be used as the materials forming the inner-cylinder-side protective film (25*c*) and the cutter-side protective film (31*b*).

Cutting Operation

The current passage disconnection device (40) of the first embodiment is used in the state in which the current passage disconnection device (40) is mounted at a predetermined position of electrical equipment.

The current passage disconnection device (40) is mounted with the igniter (37) being connected to, e.g., a fire alarm or an earthquake alarm. When the fire alarm detects fire, or when the earthquake alarm detects an earthquake, an alarm signal is input to the igniter (37). When the alarm signal is input to the igniter (37), the igniter (37) explodes the explosive in the gas generation chamber (36).

Figure 9:
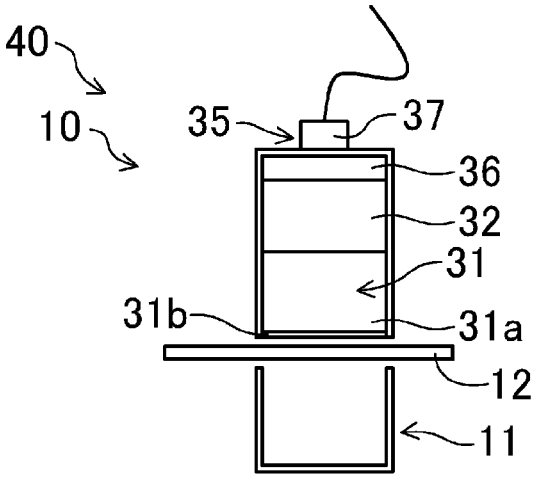
FIG. 9 is a schematic view illustrating a state of the current passage disconnection device of the first embodiment before cutting.
Figure 10:
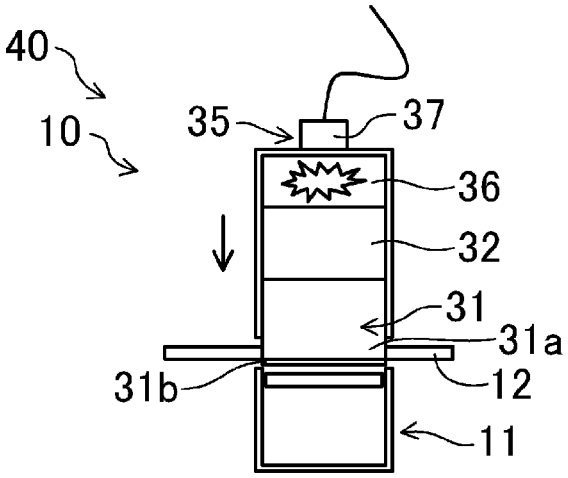
FIG. 10 is a schematic view illustrating a state of the current passage disconnection device of the first embodiment right after cutting.

When the explosive explodes, high-pressure gas is generated by such explosion, and thrust toward the front is provided to the pusher (32) in the state illustrated in FIG. 9. This moves the blade member (30) toward the harness (12). The blade member (30) moves together with the cutter-side protective film (31*b*) covering the cutting portion (31*a*) and the inner surfaces (32*b*) of the guide portions (32*a*), and the cutting portion (31*a*) quickly cuts the harness (12) as illustrated in FIG. 10. Note that the guide portions (32*a*) are not shown in FIGS. 9 and 10.

While the blade member (30) is moving forward, air in part of the cylindrical passage (17) in the front of the blade member (30) is exhausted to the outside of the cutter (10) through an exhaust air passage formed by the hole (23*c*) of the bottom portion (23*a*) of the stopper (23) and the exhaust hole (29) of the resin case (20). Because of such air exhausting, forward movement of the blade member (30) is not blocked by air compression in the front of the blade member (30) due to forward movement of the blade member (30). Thus, the blade member (30) smoothly moves forward.

Figure 11:
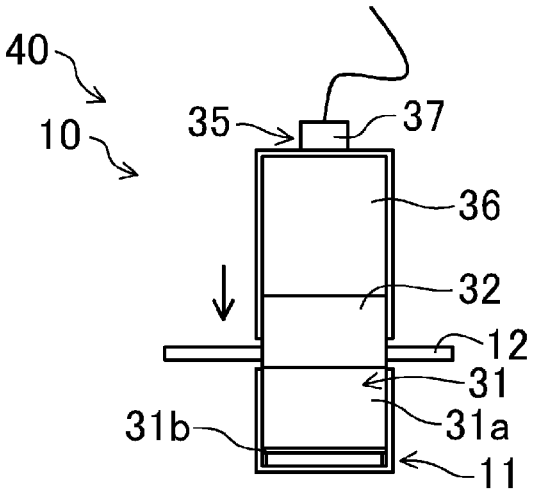
FIG. 11 is a schematic view a state of the current passage disconnection device of the first embodiment, i.e., the state in which the blade member is stopped by a stopper.

The blade member (30) further moves forward, and then the guide portions (32*a*) forming a tip end of the blade member (30) come into contact with the bottom portion of the stopper (23). The guide portions (32*a*) are deformed due to impact cause by such contact. The blade member (30) absorbs, at the guide portions (32*a*), the impact caused by contact, and is stopped in the stopper (23) without bouncing back. In such a state, since the pusher (32) is at the position where the harness (12) is cut, current does not re-flow in the harness (12) through the edge portion (31). Note that the guide portions (32*a*) are not shown in FIG. 11.

After the blade member (30) moved forward, gas filling the gas generation chamber (36) in the back of the blade member (30) is exhausted to the outside of the cutter (10) through an exhaust gas passage formed by a clearance between a front end portion of the metal case (27) and a back end surface of the second inner cylinder member (26), the through-hole (27*c*) of the metal case (27), and the exhaust passage (28) of the resin case (20). Thus, the following is reduced or prevented: gas containing conductive substances, such as cinders or products generated from the explosive, in the gas generation chamber (36) flows toward the harness (12), and discharge is generated due to the conductive substances adhered to cut surfaces of the harness (12).

Function of Protective Member

Before the cutting operation, the cutter (10) and the harness (12) may shake in the current passage disconnection device (40) depending on the surrounding environment of the mounted current passage disconnection device (40). Specifically, in the case where, e.g., a shaking device is mounted near the current passage disconnection device (40), the cutter (10) and the harness (12) are likely to shake. When the cutter (10) and the harness (12) shake as in the foregoing, the blade member (30) and the harness (12) come into contact with each other and are rubbed against each other, or the first inner cylinder member (25) and the harness (12) come in contact with each other and are rubbed against each other. As a result, the harness (12) is shaved. In such a state, metal powder is generated at the surface of the harness (12). Consequently, even after the harness (12) is cut by the cutter (10), current may flow in the harness (12) through the metal powder.

However, in the first embodiment, the cutting portion (31*a*) of the blade member (30) and the inner surfaces (32*b*) of the guide portions (32*a*) are covered by the cutter-side protective film (31*b*), and the receiving surface (25*b*) of the first inner cylinder member (25) is covered by the inner-cylinder-side protective film (25*c*). This reduces or prevents rubbing of the harness (12) against the metal edge portion (31) or the high stiffness first inner cylinder member (25) made of, e.g., ceramics. Moreover, since the protective films (25*c*, 31*b*) are made of the materials softer than that of the harness (12), generation of metal powder due to shaving of the harness (12) can be reduced even if the protective film (25*c*, 31*b*) is rubbed against the harness (12). Thus, after the harness (12) is cut by the operation of the cutter (10), re-flowing of current in the harness (12) due to the metal powder can be reduced or prevented.

Further, the protective films (25*c*, 31*b*) are made of the insulating materials. Thus, even if powder is generated due to shaving of the protective films (25*c*, 31*b*) by the harness (12), such powder does not contribute to passage of current in the harness (12).

Moreover, since the protective films (25*c*, 31*b*) are each formed so as to have a relatively-small thickness, the distance between the blade member (30) and the harness (12) and the distance between the first inner cylinder member (25) and the harness (12) can be shortened. This reduces the size of the cutter (10).

Advantages of First Embodiment

As described above, in the cutter (10) of the current passage disconnection device (40) of the present embodiment, the cutting portion (31*a*) of the edge portion (31) of the blade member (30) and the inner surfaces (32*b*) of the guide portions (32*a*) are covered by the cutter-side protective film (31*b*), and the receiving surface (25*b*) of the first inner cylinder member (25) is covered by the inner-cylinder-side protective film (25*c*). This reduces or prevents rubbing of the harness (12) against the blade member (30) and the first inner cylinder member (25). As a result, since generation of metal powder due to shaving of the surface of the harness (12) is reduced or prevented, passage of current in the harness (12) through the metal powder after cutting can be reduced.

Further, the protective films (25*c*, 31*b*) are made of the insulating materials. Thus, even if powder is generated due to rubbing of the protective film (25*c*, 31*b*) against the cutting portion (31*a*) or the first inner cylinder member (25), such powder does not contribute to passage of current in the harness (12).

Moreover, since the protective films (25*c*, 31*b*) are made of the materials softer than that of the harness (12), shaving of the surface of the harness (12) due to rubbing of the harness (12) against the protective film (25*c*, 31*b*) can be reduced.

Since the protective films (25*c*, 31*b*) are each formed so as to have a relatively-small thickness, the distance between the blade member (30) and the harness (12) which are arranged with the cutter-side protective film (31*b*) being interposed therebetween and the distance between the first inner cylinder member (25) and the harness (12) which are arranged with the inner-cylinder-side protective film (25*c*) being interposed therebetween can be shortened. This reduces the size of the cutter (10).

Variation of First Embodiment of the Invention

Figure 12:
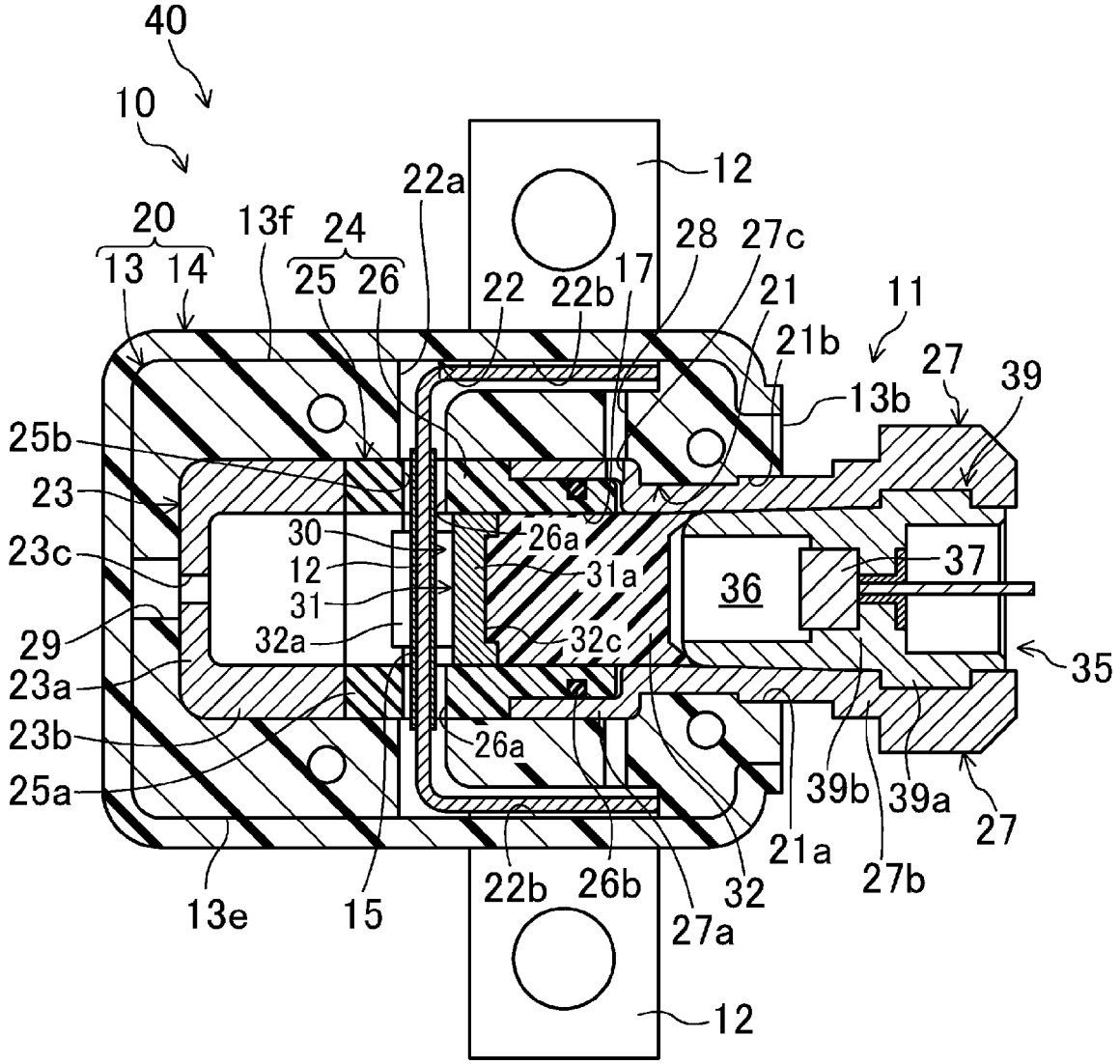
FIG. 12 is a horizontal cross-sectional view illustrating a current passage disconnection device of a first variation of the first embodiment.
Figure 13:
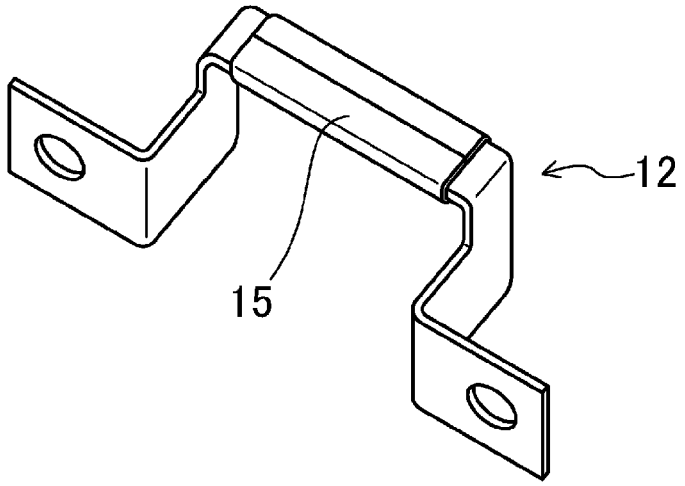
FIG. 13 is a perspective view illustrating a harness of the first variation of the first embodiment.

A current passage disconnection device (40) of a variation of the first embodiment is different from that of the first embodiment in the attachment position of the protective member (15) of the harness (12). Specifically, the protective member (15) of the current passage disconnection device (40) of the first embodiment is attached to the cutting portion (31*a*), the guide portions (32*a*), and the receiving surface (25*b*) of the first inner cylinder member (25), whereas the protective member (15) of the variation of the first embodiment is attached to the harness (12) as illustrated in FIGS. 12 and 13. Differences from the first embodiment will be mainly described below.

In the variation of the first embodiment, the blade member (30) includes, as in the first embodiment, the edge portion (31) and the pusher (32). However, the blade member (30) does not include the cutter-side protective film (31*b*). That is, the edge portion (31) and the guide portions (32*a*) are not covered by the cutter-side protective film (31*b*), and are exposed to the outside.

In the variation of the first embodiment, the first inner cylinder member (25) includes the inner cylinder portion (25*a*) having the similar shape to that of the first embodiment. However, the first inner cylinder member (25) does not include the cutter-side protective film (31*b*). That is, the receiving surface (25*b*) of the first inner cylinder member (25) is not covered by the cutter-side protective film (31*b*), and is exposed to the outside.

Referring to FIGS. 12 and 13, the protective member (15) provided in the current passage disconnection device (40) of the variation of the first embodiment is attached to the harness (12). Specifically, the protective member (15) covers a middle portion of the narrow portion (12*a*) of the harness (12) in a longitudinal direction thereof. That is, the protective member (15) covers both of the following parts: part of the surface of the harness (12) corresponding to the cutting portion (31*a*) of the edge portion (31) and the inner surfaces (32*b*) of the guide portions (32*a*); and part of the surface of the harness (12) corresponding to the receiving surface (25*b*) of the first inner cylinder member (25). The protective member (15) is formed of a protective film formed in a rectangular shape, and covers both surfaces of the narrow portion (12*a*) of the harness (12) so as to wind around the narrow portion (12*a*). Moreover, the protective member (15) of the variation of the first embodiment is, as in the first embodiment, made of an insulating resin material (specifically, polytetrafluoroethylene (PTFE) etc.) softer than the material forming the harness (12). That is, the protective member (15) is formed of a resin film for one side of which adhesion processing is performed.

According to the foregoing configuration, even if the current passage disconnection device (40) shakes before the harness (12) is cut, generation of metal powder due to rubbing of the harness (12) against the blade member (30) and the first inner cylinder member (25) can be reduced or prevented. Thus, after the current passage disconnection device (40) is operated to cut the harness (12), re-flowing of current in the harness (12) through the metal powder can be reduced or prevented. Further, the protective member (15) is made of the insulating material. Thus, even if powder is generated due to shaving of the protective member (15), the powder does not contribute to passage of current in the harness (12) after cutting. In addition, the protective member (15) is made of the material softer than the harness (12). Thus, generation of metal powder from, e.g., the harness (12) and the cutting portion (31*a*) due to rubbing of the protective member (15) against, e.g., the cutting portion (31*a*) can be reduced or prevented.

In the present variation, the protective member (15) is formed of the resin film to be adhered to the harness (12). However, the protective member (15) may be formed in such a manner that an insulating material such as ceramics is sprayed on the surface of the harness (12). In such a case, the protective member (15) is made of the material harder than the blade member (30) and the first inner cylinder member (25). As a result, the harness (12) is protected even if the harness (12) is rubbed against the blade member (30) and the first inner cylinder member (25), and therefore generation of metal powder can be reduced or prevented.

Second Embodiment of the Invention

Figure 14:
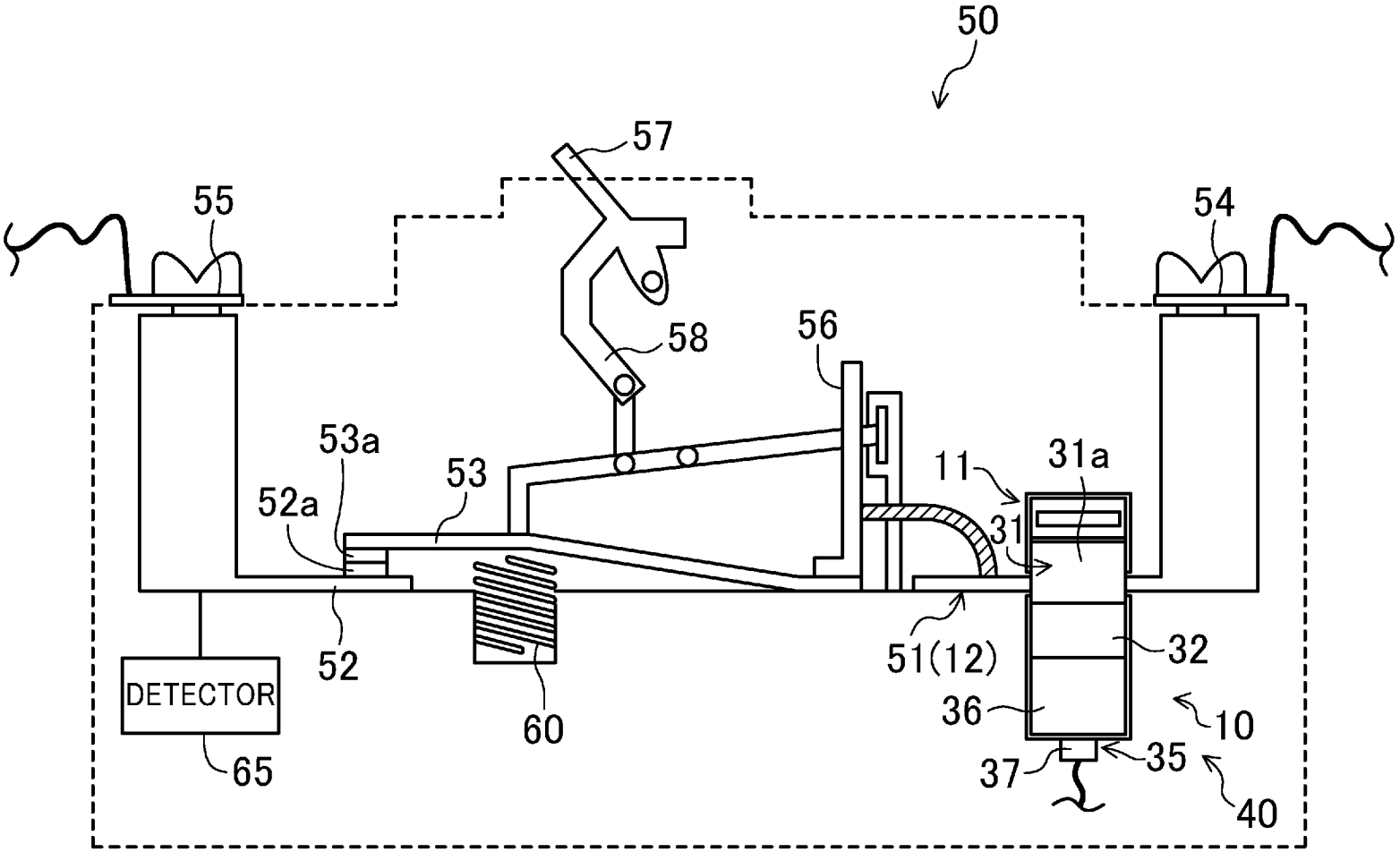
FIG. 14 is a schematic configuration diagram illustrating a breaker of a second embodiment.

Next, a second embodiment will be described. Referring to FIG. 14, the second embodiment is directed to a breaker (50) including the current passage disconnection device (40) of the first embodiment or the current passage disconnection device (40) of the variation of the first embodiment. The breaker (50) includes a load terminal (55) and a line terminal (54) provided in a resin casing (not shown in the figure), and a terminal-to-terminal connection member (51) which is a harness (12) configured to connect the load terminal (55) and the line terminal (54).

The terminal-to-terminal connection member (51) includes a stationary contact (52) connected to the load terminal (55), and a movable contact (53) connected to the line terminal (54). The movable contact (53) is movable between a contact position at which the movable contact (53) is in contact with the stationary contact (52) and a noncontact position at which the movable contact (53) is apart from the stationary contact (52). When the movable contact (53) moves to the contact position, a movable contact point (53*a*) of the movable contact (53) is in contact with a stationary contact point (52*a*) of the stationary contact (52).

Further, the breaker (50) includes a linkage mechanism (58) configured to move the movable contact (53) manually, a trip mechanism (56) configured to separate the movable contact (53) from the stationary contact (52) under abnormal current conditions, and a bias spring (60) configured to bias the movable contact (53) to separate the movable contact (53) from the stationary contact (52). The linkage mechanism (58) is attached to the casing such that the movable contact (53) is movable between the contact position and the noncontact position by operation of a manual lever (57). The trip mechanism (56) is made of bimetal, and provides connection between the movable contact (53) and the line terminal (54). The trip mechanism (56) is thermally deformed under overcurrent conditions (abnormal current conditions), and such thermal deformation allows movement of the linkage mechanism (58), thereby separating the movable contact (53) from the stationary contact (52). When the movable contact (53) is separated from the stationary contact (52), passage of current in the breaker (50) is disconnected.

Furthermore, the breaker (50) includes the foregoing current passage disconnection device (40), and a weld detector (65) configured to detect welding between the movable contact point (53*a*) and the stationary contact point (52*a*). Any one of the current passage disconnection devices (40) of the first embodiment, the variation of the first embodiment, and other embodiments described later may be used as the current passage disconnection device (40).

A cutter (10) of the current passage disconnection device (40) is positioned so as to be able to cut the terminal-to-terminal connection member (51). Specifically, the cutter (10) is located on a back surface (i.e., a lower surface as viewed in FIG. 14) of the terminal-to-terminal connection member (51).

The weld detector (65) is connected to, e.g., the terminal-to-terminal connection member (51), and is configured to detect, based on a current value of the terminal-to-terminal connection member (51), whether or not the movable contact point (53*a*) and the stationary contact point (52*a*) are welded together. An igniter (37) of the cutter (10) is connected to the weld detector (65). When the weld detector (65) determines that the movable contact point (53*a*) and the stationary contact point (52*a*) are welded together, the weld detector (65) actuates the igniter (37).

In the second embodiment, when the weld detector (65) determines that the movable contact point (53*a*) and the stationary contact point (52*a*) are welded together, the igniter (37) is actuated to explode an explosive, and a blade (30) moves forward. The blade (30) cuts (i.e., breaks) the terminal-to-terminal connection member (51), and then the pusher (32) stops in the state in which the pusher (32) is in contact with cut surfaces of the terminal-to-terminal connection member (51). This allows insulation between the cut surfaces of the terminal-to-terminal connection member (51), thereby disconnecting passage of current between the line terminal (54) and the load terminal (55).

Advantages of Second Embodiment

In the second embodiment, the current passage disconnection device (40) can forcibly disconnect passage of current between the line terminal (54) and the load terminal (55). Thus, e.g., even when the movable contact (53) and the stationary contact (52) are welded together, the current passage disconnection device (40) can forcibly disconnect passage of current between the line terminal (54) and the load terminal (55) to reduce or prevent breakdown of a load-side device. Other configurations, features, and advantages are the same as those of the first embodiment or the variation of the first embodiment.

Third Embodiment of the Invention

Figure 15:
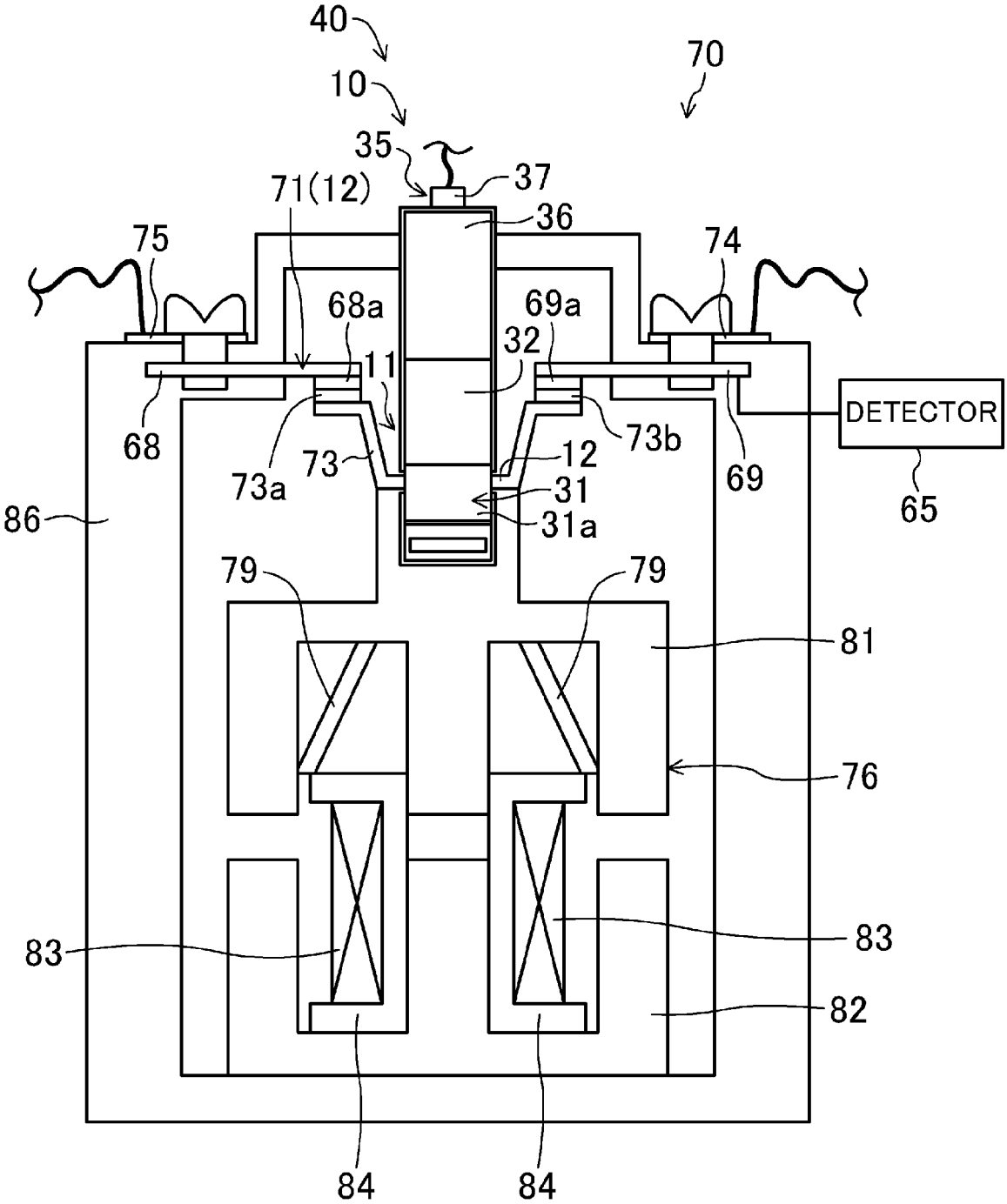
FIG. 15 is a schematic configuration diagram illustrating a contactor of a third embodiment.

Next, a third embodiment will be described. Referring to FIG. 15, the third embodiment is directed to a contactor including the current passage disconnection device (40) of the first embodiment or the current passage disconnection device (40) of the variation of the first embodiment. Referring to FIG. 15, the contactor (70) includes a load terminal (75) and a line terminal (74) provided in a resin casing (86), and a terminal-to-terminal connection member (71) which is a harness (12) configured to connect the load terminal (75) and the line terminal (74).

The terminal-to-terminal connection member (71) includes a first stationary contact (68) connected to the load terminal (75), a second stationary contact (69) connected to the line terminal (74), and a movable contact (73) coupled to a movable core (81) described later. The movable contact (73) is movable between a contact position at which the movable contact (73) is in contact with the pair of stationary contacts (68, 69) and a noncontact position at which the movable contact (73) is apart from the pair of stationary contacts (68, 69). When the movable contact (73) moves to the contact position, a movable contact point (73*a*) of the movable contact (73) at one end thereof comes in contact with a first stationary contact point (68*a*) of the first stationary contact (68), and a movable contact point (73*b*) of the movable contact (73) at the other end thereof comes in contact with a second stationary contact point (69*a*) of the second stationary contact (69).

Further, the contactor (70) includes a moving mechanism (76) configured to move the movable contact (73) between the contact position and the noncontact position. The moving mechanism (76) includes the movable core (81), a stationary core (82), an exciting coil (83), and a spool (84). The stationary core (82) is fixed to a bottom surface of the casing (86). The movable core (81) faces an upper surface of the stationary core (82). The exciting coil (83) is wound around the spool (84). A pair of return springs (79) are provided between the movable core (81) and the spool (84) to separate the movable core (81) the stationary core (82) from each other when the contactor (70) is under non-energized conditions.

The transfer mechanism (76) is configured such that the stationary core (82) is, when passage of current in the exciting coil (83) is allowed by an external signal, excited to attract the movable core (81). When the stationary core (82) is separated from the movable core (81), the contactor (70) is in a non-energized state. By contrast, the transfer mechanism (76) is configured such that the return springs (79) separate, when passage of current in the exciting coil (83) is stopped by an external signal, the movable core (81) from the stationary core (82). When the movable core (81) is attracted by the stationary core (82), the contactor (70) is in a non-energized state.

Furthermore, the contactor (70) includes the foregoing current passage disconnection device (40) and a weld detector (65) having a configuration similar to that of the second embodiment. Any one of the current passage disconnection devices (40) of the first embodiment, the variation of the first embodiment, and other embodiments described later may be used as the current passage disconnection device (40).

A cutter (10) of the current passage disconnection device (40) is positioned so as to be able to cut the terminal-to-terminal connection member (71). Specifically, the cutter (10) is disposed such that a cutting portion (31) of a blade (30) which does not yet move forward faces a front surface of the movable contact (73).

In the third embodiment, when the weld detector (65) determines that the movable contact points (73*a*, 73*b*) are each welded to a corresponding one of the stationary contact points (68*a*, 69*a*), an igniter (37) is actuated to explode an explosive, and the blade (30) moves forward. The blade (30) cuts the movable contact (73). In such a state, a pusher (32) is in contact with cut surfaces of the movable contact (73). That is, the blade (30) moves forward until the pusher (32) comes in contact with the cut surfaces of the movable contact (73).

Advantages of Third Embodiment

In the third embodiment, the current passage disconnection device (40) can forcibly disconnect passage of current between the line terminal (74) and the load terminal (75). Thus, e.g., even when movable contact (73) and the stationary contacts (68, 69) are welded together, the current passage disconnection device (40) can forcibly disconnect passage of current between the line terminal (74) and the load terminal (75) to reduce or prevent breakdown of a load-side device.

Fourth Embodiment of the Invention

Figure 16:
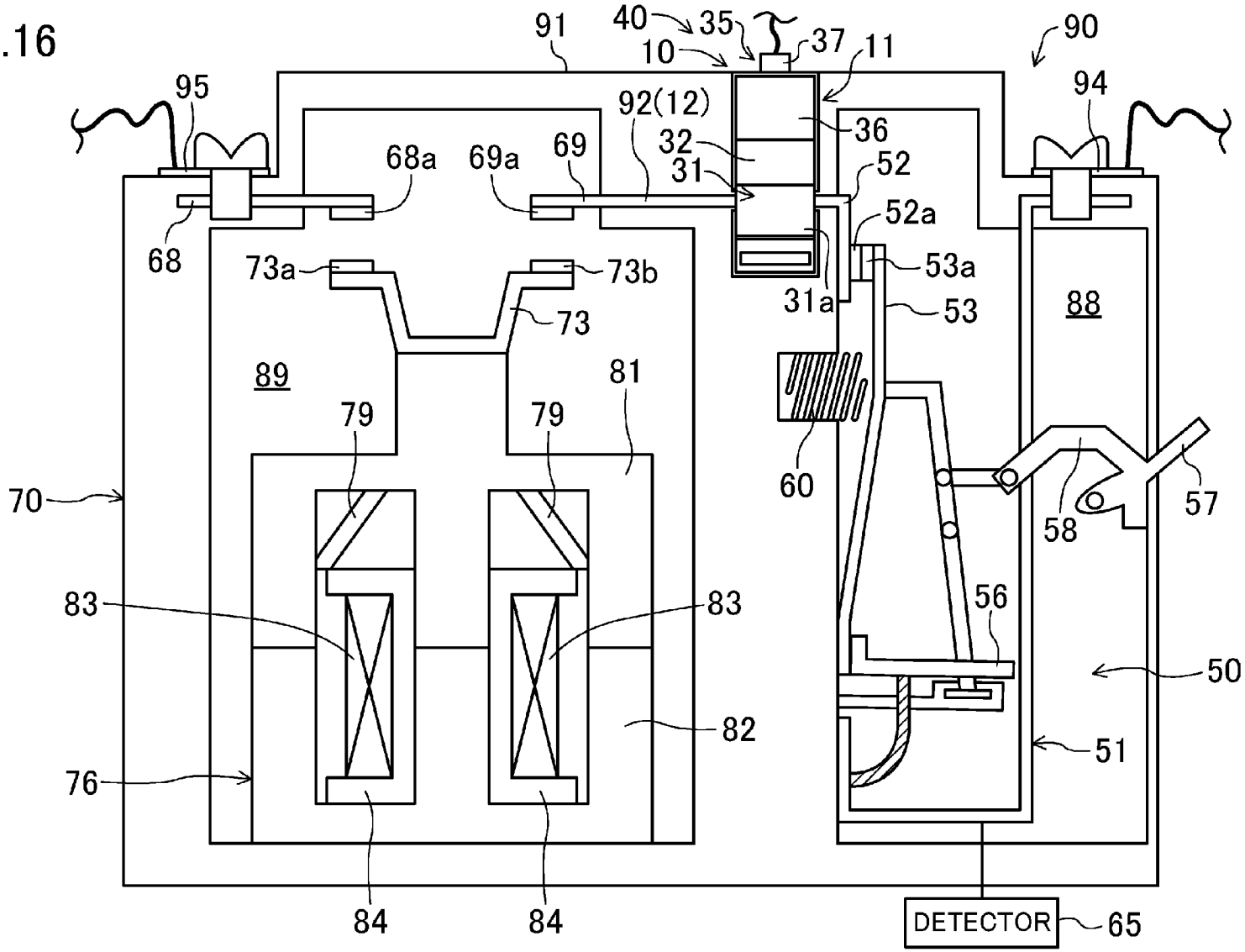
FIG. 16 is a schematic configuration diagram illustrating an electric circuit breaker of a fourth embodiment.

Next, a fourth embodiment will be described. Referring to FIG. 16, the fourth embodiment is directed to an electric circuit breaker (90) including the current passage disconnection device (40) of the first embodiment or the current passage disconnection device (40) of the variation of the first embodiment. The electric circuit breaker (90) includes a breaker (50), a contactor (70), and a resin casing (91). Description of the breaker (50) and the contactor (70) is not repeated.

A breaker chamber (88) in which the breaker (50) is arranged and a contactor chamber (89) in which the contactor (70) is arranged are formed in the casing (91) with a barrier being interposed therebetween. The casing (91) further includes a load terminal (95), a line terminal (94), and a connection member (92) providing connection between the breaker (50) and the contactor (70). The connection member (92) is a harness (12).

The load terminal (95) is connected to a first stationary contact (68) of the contactor (70). The line terminal (94) is connected to a movable contact (53) of the breaker (50). Further, one end of the connection member (92) is connected to a second stationary contact (69) of the contactor (70). The other end of the connection member (92) is connected to a stationary contact (52) of the breaker (50).

Moreover, the electric circuit breaker (90) includes the foregoing current passage disconnection device (40) and a weld detector (65) similar to that of the second embodiment. Any one of the current passage disconnection devices (40) of the first embodiment, the variation of the first embodiment, and other embodiments described later may be used as the current passage disconnection device (40).

A cutter (10) of the current passage disconnection device (40) is positioned so as to be able to cut the connection member (92). Specifically, the cutter (10) is disposed such that a cutting portion (31) of a blade (30) which does not yet move forward faces a front surface of the connection member (92).

In the fourth embodiment, when the weld detector (65) determines that the movable contact (53) and the stationary contact (52) are welded together in the breaker (50), or when the weld detector (65) determines that the movable contact (73) and the stationary contacts (68, 69) are welded together in the contactor (70), the weld detector (65) actuates an igniter (37), and the blade (30) moves forward to cut (i.e., break) the connection member (92). In such a state, a pusher (32) is in contact with cut surfaces of the connection member (92). That is, the blade (30) moves forward until the pusher (32) comes in contact with the cut surfaces of the connection member (92).

Advantages of Fourth Embodiment

In the fourth embodiment, the cutter (10) cuts the connection member (92), thereby disconnecting passage of current between the line terminal (94) and the load terminal (95). Thus, e.g., even when welding occurs in the breaker (50) or the contactor (70), the cutter (10) can disconnect passage of current between the line terminal (94) and the load terminal (95) to reduce or prevent breakdown of a load-side device.

OTHER EMBODIMENTS

The foregoing embodiments may have the following configurations.

The current passage disconnection device (40) of the first embodiment includes the protective member (15) covering the edge portion (31) of the blade member (30), the guide portions (32*a*), and the receiving surface (25*b*) of the first inner cylinder member (25), but the present disclosure is not limited to such a configuration. The protective member may cover only the edge portion (31) of the blade member (30) and the guide portions (32*a*), or may cover only the receiving surface (25*b*) of the first inner cylinder member (25).

Similarly, the current passage disconnection device (40) of the variation of the first embodiment includes the protective member (15) covering part of the surface of the harness (12) corresponding to, e.g., the edge portion (31) of the blade member (30) and part of the surface of the harness (12) corresponding to the receiving surface (25*b*) of the first inner cylinder member (25), but the present disclosure is not limited to such a configuration. The protective member (15) may cover only part of the surface of the harness (12) corresponding to the blade member (30), or may cover only part of the surface of the harness (12) corresponding to the receiving surface (25*b*) of the first inner cylinder member (25).

In each of the foregoing embodiments, the protective member (15) is formed so as to have a small thickness, but the present disclosure is not limited to such a configuration. The protective member (15) may be formed in a plate shape or a columnar shape so as to have a certain thickness.

In the first embodiment, the protective member (15) covers only the edge portion (31) and the first inner cylinder member (25). In the variation of the first embodiment, the protective member (15) covers only the harness (12). However, the present disclosure is not limited to such configurations. The protective member may cover all of the edge portion (31), the first inner cylinder member (25), and the harness (12). It can be ensured that the harness (12) is protected.

INDUSTRIAL APPLICABILITY

As described above, the present disclosure is particularly useful for the cutter and the current passage disconnection device.

DESCRIPTION OF REFERENCE CHARACTERS

10 Cutter
12 Harness (Current-Carrying Member)
15 Protective Member (Protective Member, Protective Film)
23 Stopper
25 First Inner Cylinder Member (Receiving Member)
25*b* Receiving Surface
30 Blade Member
31 Edge Portion
31*a* Cutting Portion
32 Pusher (Insulating Portion)
35 Gas Generator
40 Current Passage Disconnection Device

The invention claimed is:

1. A cutter, comprising:

a blade member including an insulating portion and an edge portion for cutting a current-carrying member;

a gas generator that generates high-pressure gas to move the blade member toward the current-carrying member;

a receiving member arranged on a side opposite to the edge portion relative to the current-carrying member and defining a receiving surface for receiving the current-carrying member upon cutting thereof;

a stopper that restricts forward movement of the blade member such that the insulating portion of the blade member stops, after cutting of the current-carrying member, at a position corresponding to a cut surface of the current-carrying member; and an insulating protective member positioned between at least one of the blade member or the receiving member and the current-carrying member, the insulating member protecting a surface of the current-carrying member facing the at least one of the blade member or the receiving member.

2. The cutter of claim 1, wherein the protective member is provided on the current-carrying member so as to cover surfaces of the current-carrying member facing the blade member and the receiving member.

3. The cutter of claim 1, wherein the protective member is provided on the edge portion, guide portions formed in a front end portion of the blade member so as to sandwich the current-carrying member, and the receiving member so as to cover a surface of the edge portion, inner surfaces of the guide portions, and the receiving surface of the receiving member.

4. The cutter of claim 2, wherein the protective member is made of a material softer than the current-carrying member.

5. The cutter of claim 2, wherein the protective member is formed in close contact with the surfaces of the current-carrying member.

6. The cutter of claim 1, wherein the protective member is a protective film formed in a membrane.

7. The cutter of claim 3, wherein the protective member is made of a material softer than the current-carrying member.

8. The cutter of claim 2, wherein the protective member is a protective film formed in a membrane.

9. The cutter of claim 3, wherein the protective member is a protective film formed in a membrane.

10. The cutter of claim 4, wherein the protective member is a protective film formed in a membrane.

11. The cutter of claim 5, wherein the protective member is a protective film formed in a membrane.

* * * * *